United States Patent [19]

Henninghaus

[11] 4,144,679

[45] Mar. 20, 1979

[54] HONING TOOL

[75] Inventor: Franz Henninghaus, Dormagen, Fed. Rep. of Germany

[73] Assignee: Ferdinand Henninghaus, Fed. Rep. of Germany

[21] Appl. No.: 862,418

[22] Filed: Dec. 20, 1977

[30] Foreign Application Priority Data

Dec. 31, 1976 [DE] Fed. Rep. of Germany ..... 2659766

[51] Int. Cl.[2] ..... B24B 33/08

[52] U.S. Cl. ..... 51/338; 51/344; 51/346

[58] Field of Search ..... 51/331, 338, 339, 340, 51/344, 346, 349, 353, 341, 342, 343, 345

[56] References Cited

U.S. PATENT DOCUMENTS

| | | | |
|---|---|---|---|
| 1,831,172 | 11/1931 | Hall | 51/346 |
| 2,195,061 | 3/1940 | Wallace | 51/346 |
| 2,537,286 | 1/1951 | Stovall | 51/339 |

FOREIGN PATENT DOCUMENTS

| | | | |
|---|---|---|---|
| 1387465 | 3/1975 | United Kingdom | 51/338 |

*Primary Examiner*—Harold D. Whitehead

*Assistant Examiner*—Robert P. Olszewski

*Attorney, Agent, or Firm*—Robert E. Burns; Emmanuel J. Lobato; Bruce L. Adams

[57] ABSTRACT

The invention relates to a honing tool which comprises an elongate housing and a thrust body displaceable longitudinally in the housing, the thrust body comprising a thrust plate and the thrust plate having opposed inclined edge surfaces which form slideways. The slideways engage with corresponding inclined surfaces on thrust members which are movable transversely to the longitudinal axis of the thrust body, the thrust members being connected to arcuate shells mounted around the housing for movement radially outwardly therefrom against a spring bias in response to longitudinal movement of the thrust body. The arcuate shells mounted in use cutting devices and the thrust members are arranged in pairs, the or each pair comprising a cylinder and a piston slidable therein. The inner ends of the cylinders and pistons are each slotted and receive therethrough the thrust plate. The closed ends of the slots form surfaces inclined, correspondingly with the inclination of the thrust plate edge surfaces, to the longitudinal axis of the thrust body.

8 Claims, 8 Drawing Figures

HONING TOOL

The invention relates to a rotatable honing tool comprising a housing in which a thrust body can be displaced axially by, for example, a hydraulically actuated plunger from an initial position in the direction towards the front end of the honing tool, the chuck end of the tool being the rear end, and provided with respective slideways inclined at an angle to the longitudinal axis of the thrust body for engagement with correspondingly inclined oblique faces on thrust bolts which are guided to be movable transversely to the longitudinal axis of the thrust body in bores in the housing. The thrust bolts have the purpose of moving outwardly two shells which lie opposite one another, which have cutter devices such as cutter bars, which are arched in cross-section and which are guided by a telescopic mounting arranged transversely in the housing in the same longitudinal plane of the honing tool as the thrust bolts, the shells being retractable by spring tension automatically from a spread position into their initial position.

In the case of a honing tool of the foregoing kind a cylindrical thrust body which consists of two parts lying one behind the other and is guided in a hollow cylindrical housing, exhibits, in the region of the thrust bolts and respectively facing them, slideways inclined with respect to the longitudinal central axis of the thrust body and starting from about the longitudinal central plane of the thrust body. The oblique faces formed on the underside of each thrust bolt engage with the slideways so that the thrust bolts are forced outwards and the shells are moved from the starting position into one of a plurality of possible spread positions when the thrust body is displaced, by means of the hydraulically actuated plunger, in the longitudinal direction of the tool. The amount of spread of the shells which can be achieved is dependent upon the maximum attainable displacement of the thrust bolts. In order to increase this stroke of the thrust bolts the thrust body exhibits between the slideways, arranged respectively in pairs, a central way, re-entrant with respect to the latter, with which corresponds an appropriately bevelled guide-web on the underside of each thrust bolt. By this measure the thrust bolts can travel out further than was possible hitherto without the inner ends of the thrust bolts losing the secure guiding engagement with the thrust body.

The telescopic mounting of the shells consists of a central bolt which is subdivided into two central bolt halves which engage in one another telescopically and guide one another mutually, one of which is firmly connected to each of the two shells and is guided in an appropriately dimensioned bore in the housing. The telescopic subdivision of the central bolt guarantees secure guidance of the shells even when longer strokes are performed as possible through the aforesaid construction of the thrust bolts.

The honing tool described above is distinguished furthermore by silence in operation, but the stroke of the thrust bolts and shells which can be attained is restricted to about the dimension which corresponds with the internal radius of the housing, and the contact pressure which can be attained by the shells against the face of the workpiece to be machined, by which the cutting power is determined, is limited, because the possible contact pressure in the case of a given thrust of the hydraulically actuated plunger is determined by the slope of the slideways and oblique faces with respect to the longitudinal central plane of the honing tool as well as by the guidance properties. In the case of likewise predetermined shell and tool length which for satisfactory machining is chosen to be as short as possible, the distance along which the slideways can be arranged on the parts of the thrust body is relatively short. The central bolt contributes considerably to this, its guidance in the thrust body in the form of an elongated hole claiming a relatively large space. The slope of the slideways and oblique faces caused in this case restricts the transmission ratio upon the transfer of the thrust from the plunger to the thrust bolts and hence permits no increase in the contact pressure of the shells against the surface being machined. If one were to reduce the slope of the slideways a higher contact pressure would indeed be possible but at the same time the possible stroke of the thrust bolts and shells would have to be reduced.

The problem therefore exists of making a honing tool of the kind mentioned initially in such a way that heavier contact pressure of the shells against the surface to be machined can be achieved and hence higher cutting power without restriction of the possible stroke of the shells and thrust bolts.

In accordance with the invention a honing tool comprises an elongate housing; and a thrust body displaceable longitudinally in the housing and having a thrust plate extending longitudinally, the thrust plate including opposed edge surfaces inclined to the longitudinal axis of the thrust body to form slideways engaging with correspondingly inclined surfaces on thrust members movable transversely to the longitudinal axis of the thrust body, the thrust members being connected to arcuate shells mounted around the housing for movement radially outwardly therefrom against a spring bias in response to longitudinal movement of the thrust body and for mounting cutting devices, the thrust members being arranged in pairs and the or each pair comprising a cylinder and a piston slidable therein, the inner ends of the cylinder and piston each being slotted to receive therethrough the thrust plate, the closed ends of the slots forming surfaces inclined, correspondingly with the inclination of the thrust plate edge surfaces, to the longitudinal axis of the thrust body.

With this construction the thrust cylinders and thrust pistons control not only the spreading apart of the shells but also their mounting and guidance. By the omission of the usual central bolt there is available on the thrust body or its thrust plates respectively a considerably greater distance for the arrangement of the slideways, so that with the same stroke a considerably shallower slope may be imparted to the slideways with respect to the longitudinal central axis of the thrust body. A considerably more favourable transfer of the thrust of the plunger to the thrust piston and thrust cylinder is thereby made possible so that the contact pressure by the shells against the surface to be machined is significantly increased without the predetermined hydraulic pressure of the honing machine having to be raised. Alternatively, the space which has become free can be used for shortening the length of the tool.

The contact pressure can be raised by the improved guidance of the thrust members formed as pistons and cylinders and a reduction in the frictional losses hereby achieved.

The stroke of the thrust members and shells hitherto achievable is not only maintained, but because of the improved guidance can be increased. The guidance of the shells is still further improved because the telescopic guiding contact between the thrust piston and the thrust cylinder which corresponds in principle with the guiding contact in the previous central bolt, subdivided telescopically, is instead of as hitherto in the centre of the shells, brought about at two points on the shells lying remote from one another. Even in the outermost spread position the inner ends of the thrust pistons and thrust cylinders remain in contact.

Preferably, as before two pairs of thrust members are made use of.

The primary slideways lying in each case on the top and bottom sides of the thrust plate are in contact with the primary oblique faces which are formed on the inner boundary surfaces of the slots. In the case of the thrust piston the primary oblique face traverses the whole cross-section of the thrust piston, whilst in the case of the thrust cylinder it is divided and lies in sections of the wall of the thrust cylinder which lie opposite one another.

The contact preserved between the thrust pistons and the thrust cylinders in any position of spread which can be reached guarantees secure guidance of the thrust pistons and thrust cylinders and correspondingly of the shells themselves in radial and axial planes.

In further development of the invention the cylinder or piston slots include a step in at least one sidewall, the step being parallel to the inclined surface of the slot end to form a second inclined surface parallel to the first; and the thrust plate including complementary inclined steps forming a second slideways on the sideface of the thrust plate parallel with the edge sideway surface, the distance between the two slideways measured in the direction transverse to the longitudinal direction of the thrust body being equal to the distance between the first and second inclined surfaces on the thrust members measured in the same direction.

By this further development, in addition to the increased contact pressure of the shells, a considerable increase in the possible stroke of the thrust pistons and thrust cylinders as well as of the shells is achieved. Upon spreading the shells from the starting position, first of all the primary slideways and oblique faces only are in contact with one another. After performance of part of the stroke the secondary slideways which meanwhile have been moved in the longitudinal direction of the tool also come into contact with the secondary oblique faces on the thrust piston and thrust cylinder and after performance of a further part of the stroke take over from the primary slideways and oblique faces as the radially outer ends of the primary slideways are reached.

In that case, it is very essential that the thrust pistons and thrust cylinders continue in contact with one another at their inner ends so that secure guidance of the thrust pistons and thrust cylinders themselves as well as the shells is guaranteed. The possible amount of extension of the stroke goes far beyond the internal radius of the housing.

Though it is in principle possible to make the secondary slideways and oblique faces only on one side of the thrust plate as and thrust pistons it is advantageous to provide them in each case in pairs on opposite sides. Furthermore, it is possible to arrange more than one pair of secondary slideways and oblique faces one behind the other or one above the other respectively.

The specified spacings guarantee simultaneous contact between the primary and secondary slideways and oblique faces and thereby enable stepless transfer of the thrust action from the primary to the secondary slideways.

For guidance of the thrust body inside the housing as well as for further improvement of the stability of guidance of the thrust pistons and thrust cylinders, the housing may exhibit a bore running in the longitudinal direction in which a onepiece or multiple piece cylindrical guide-body having a central longitudinal slot as a guide for the thrust body is fixed detachably, crossbores for receiving and guiding the thrust cylinders being provided in the guide-body. It is advantageous to produce the guide-body from two longitudinal sections, which for the formation of the longitudinal slot are fixed at a distance apart in the bore in the housing.

Return springs for the return of the shells from the spread position into the starting position may be provided in the form of conventional helical springs which grip round the shells outside and are arranged there in appropriate grooves. But preferably in the housing and in the guide-body on each side of the longitudinal slot and spaced from it at least one bore is provided for a spring to pass through, the ends of which are in each case fastened detachably to the shells with prestressing of the spring. This arrangement of springs lying internally protects the springs themselves and avoids undesirable need for space for the springs on the outside of the tool.

In order to enable easy fastening of the shells onto the ends of the springs the end of the springs are preferably fastened into discs which are let into the housing movably at the two ends of the bores and which exhibit a tapped hole for fixing the associated shell by a screw. Upon exchanging the shells one only needs to undo on each shell one screw by means of which the shells are fastened to the discs.

For the arrangement of the springs and for simultaneous fixing of the guide-body inside the housing the springs may be arranged in bushes which, for fixing the onepiece or multiple piece guide-body, extend through the bores in the latter as well as the bores in the housing.

The guide-body is advantageously sub-divided into four guide-cheeks which are fixed respectively in pairs opposite one another in the housing, for example, by screws which engage in the guide-cheeks through the housing from the outside. In this case the springs extend freely through the gap between the two pairs of guide-cheeks and/or through sleeves which traverse the free gap.

In a further refinement for improvement of handling in releasing or respectively exchanging the shells it is provided that leaf-springs can be fastened underneath the shells, which at least partially overlap the thrust pistons and secure them when the associated shell is released.

One example of a honing tool according to the invention is explained in greater detail below with the aid of the accompanying drawings, in which.

Figure 1:
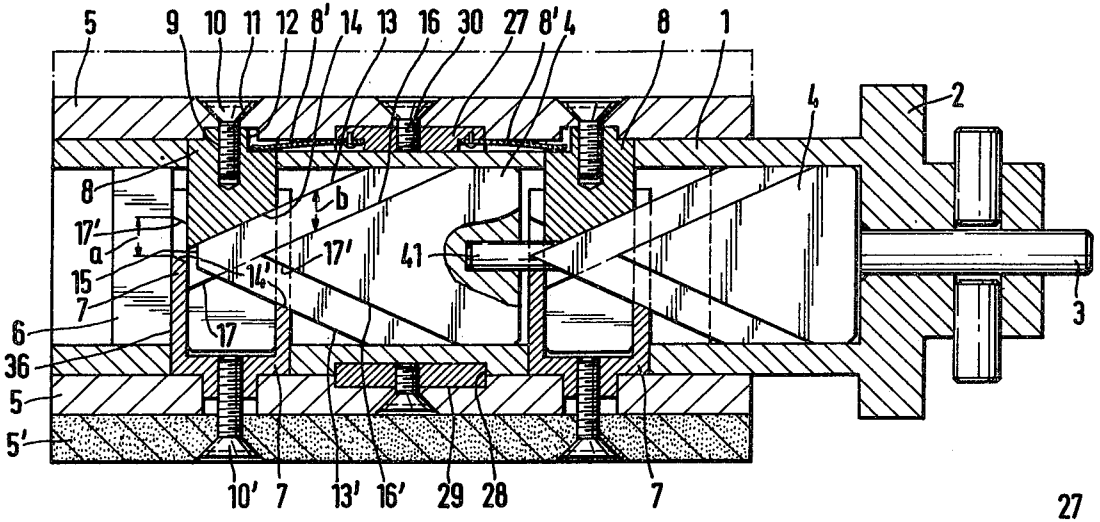
FIG. 1 is a longitudinal section through the honing tool.

In the case of the honing tool illustrated in FIG. 1, a cylindrical housing 1 is provided with an ordinary chuck end 2 and a connecting rod 3 (of a hydraulic plunger) which is connected to a thrust body having two trust plates 4.

A pair of shells 5 set with cutter bars (not shown) can be moved by means of specially constructed thrust bolts from an initial position illustrated into different working positions.

Instead of the previously usual pairs of thrust bolts, the shells 5 are supported and guided by two pairs of thrust cylinders 7 and associated thrust pistons 8. The connection between the shells 5 and the thrust cylinders or thrust pistons 7 or 8 respectively is carried out either by means of screws 10 which are screwed into correspondingly tapped holes 9, whereby possible tilting of the shells 5 is securely prevented, by engagement between a collar 12 at the top end of the thrust piston or thrust cylinder 8 or 7 respectively and an optionally cylindrical bore 11 on the inside of the shell 5. In the lower half of FIG. 1 is illustrated additionally the fact that by employing a correspondingly longer screw 10' shell caps 5' may be employed, which make prior loosening and removal of the shells 5 lying underneath superfluous.

On the top side and likewise on the bottom side of the two thrust plates 4 which are each wedge-shaped at the front lie primary slideways 13, 13' which are in contact with a primary oblique face 14, 14', of corresponding slope, on the thrust piston 8 or thrust cylinder 7 respectively. The front 15, at least, of the front thrust plate 4 is advantageously flattened off.

Figure 4:
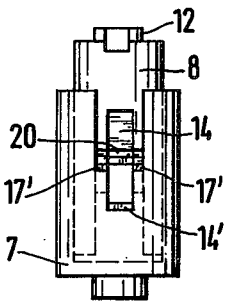
FIG. 4 is a side elevation of a thrust piston-thrust cylinder pair.
Figure 3:
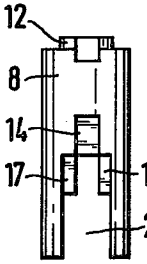
FIG. 3 is a side elevation of a thrust piston of the thrust cylinder.
Figure 2:
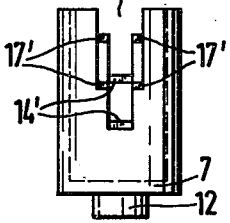
FIG. 2 is a side elevation of a thrust cylinder of the honing tool.

In order to achieve this contact each thrust piston-thrust cylinder pair (see also FIG. 4) has a passage 20 which is formed from corresponding slots 21, 22 (see FIGS. 2 and 3) in the interengaging thrust piston and thrust cylinder 8 and 7 respectively. The primary oblique faces 14 and 14' respectively are at the inner ends of the slots 21 and 22 respectively.

For extension of the stroke of the thrust piston and thrust cylinder 8 and 7 respectively or for enabling a smaller slope of the primary slideways 14, 14' as already fully explained in introduction, secondary slideways 16, 16' are formed in pairs on opposite sides of the thrust plates 4. These come into contact with correspondingly inclined secondary oblique faces 17, 17' on the thrust piston 8 and on the thrust cylinder 7 respectively. In that case the distances a between the primary and secondary oblique faces correspond with the distance b (measured in the direction transverse to the tool axis) between the primary and secondary slideways.

Figure 5:
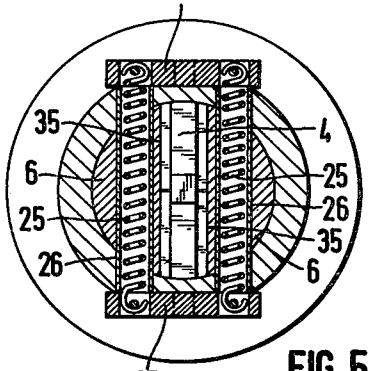
FIG. 5 is a side elevation of a spring mechanism used to return the shells.
Figure 6:
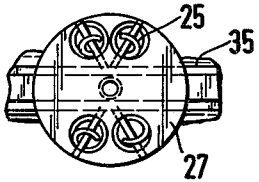
FIG. 6 is a plan of the spring arrangement.

For the return of the shells 5 from a spread position into the initial position illustrated in FIG. 1, a spring arrangement is used which is shown about in the middle of FIG. 1 and repeated in FIGS. 5 and 6 in other views. Four helical springs 25 extend through bushes 26 and are fastened at their ends under prestress to discs 27. The discs 27 are let into recesses 28 in the housing 1 and 29 in the inside of the shells 5 with a clearance. The shells 5 are respectively connected by means of a screw 30 to the adjacent disc 27.

For guidance of the thrust plates 4 and also of the thrust cylinders 7 a multiple part cylindrical guide-body 6 is used, which has a central longitudinal slot 35 for the thrust plate 4 to pass through and corresponding bores 36 for guidance of the thrust cylinders 7. The fixing of the two halves of the guide-body 6, is achieved by the bushes 26 which extend transversely through the housing 1 and the guide-body 6.

If the shell 5 is released from the thrust piston 8, leaf springs 8' fixed to the underside of the disc 27 advantageously prevent possible slipping of the thrust pistons 8 out of the housing 1 and the associated thrust cylinder 7.

Figure 7:
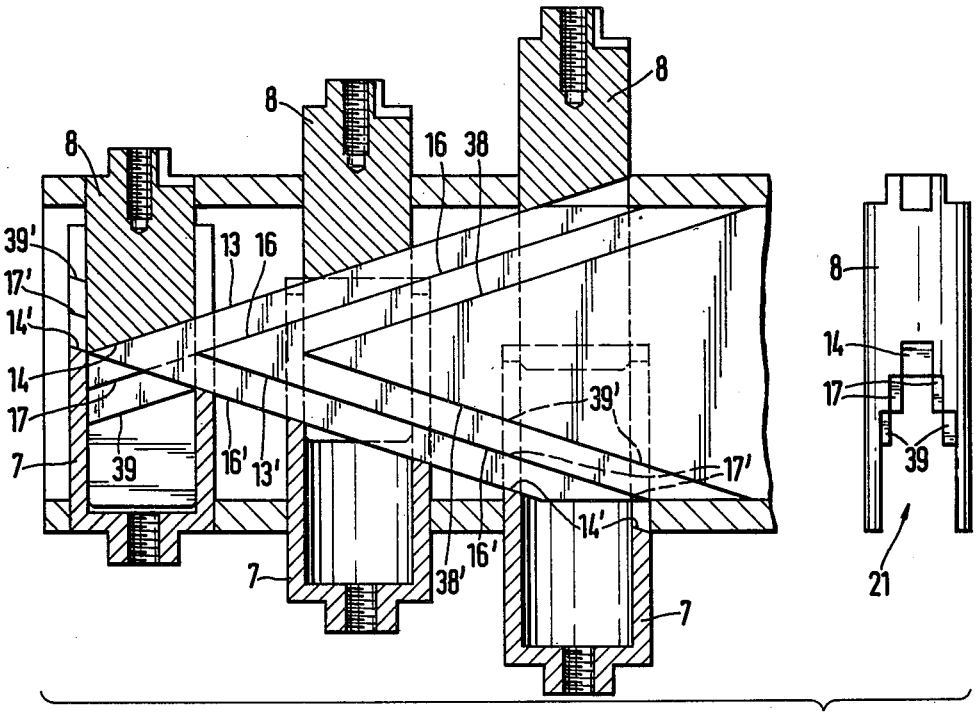
FIG. 7 illustrates different positions of spread of a thrust piston-thrust cylinder pair having three pairs of slideways and oblique surfaces; and, FIG. 8 is two longitudinal sections of a modified honing tool.

FIG. 7 shows the cooperation of one of the thrust plates 4 with a thrust cylinder-thrust piston pair 7, 8 in different positions. Besides the primary and secondary slideways and oblique faces tertiary slideways and oblique faces 38, 38' and 39, 39' respectively are shown in this case. In the starting position shown in the left-hand part of the figure only the primary slideways and oblique faces are in contact with one another. In the middle position the primary, secondary and tertiary slideways and obliques faces are carrying jointly the load whilst in the outermost position, shown on the right, the secondary and tertiary slideways and oblique faces alone support the load as the primary surfaces have already come out of contact.

Figure 8:
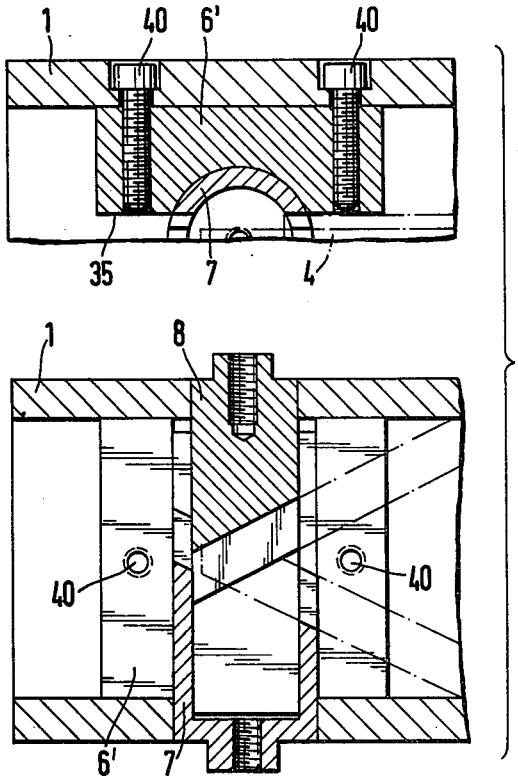

As shown in FIG. 8 the guide-body 6 may be subdivided into guide cheeks 6' also arranged in pairs, which in each case are fixed into the housing 1 by lateral bolted attachments 40. In this case the return springs (not shown in FIG. 8) may extend freely through the housing 1, that is, in the laterial sections which are not touched upon sliding the thrust plates 4. A further alternative consists in the thrust plates being set individually one behind another but not connected together. The pneumatic or hydraulic pressure is transferred from the rear thrust plate 4 via, for example, a corresponding plunger 41 to the rear of the front thrust plate 4.

I claim:

1. A honing tool comprising an elongate housing; a thrust body displaceable longitudinally in said housing, said thrust body comprising a thrust plate extending longitudinally, said thrust plate including opposed edge surfaces, said edge surfaces being inclined to said longitudinal axis of said thrust body and forming slideways; thrust members movable transversely to said longitudinal axis of said thrust body, said thrust members being arranged in pairs and each of said pairs comprising a cylinder and a piston slidable therein, each of said cylinders and pistons including an inner end, said inner ends being slotted and the closed ends of said slots forming surfaces inclined parallel to and engaged with said thrust plate edge surfaces; and arcuate shells mounted around said housing for movement radially outwardly therefrom, said shells being connected to said thrust members and being spring biased inwardly, said arcuate shells being adapted for mounting cutting devices.

2. A honing tool according to claim 1, wherein each of said slots includes a step in at least one side wall, said step being parallel to the inclined surface of said slot end to thereby form a second inclined surface parallel to said first; and said thrust plate including a second slideway inclined parallel with said first edge surface, the distance between said slideways measured in the direction transverse to the longitudinal direction of the thrust body being equal to the distance between the first and second inclined surfaces on the thrust members measured in said same direction.

3. A honing tool according to claim 1, wherein said housing defines a longitudinal bore, said bore containing a cylindrical guide body, said cylindrical guide body having a central longitudinal slot and said thrust plate being guided in said slot; and a plurality of cross-bores provided in said guide body, said cross-bores containing said thrust cylinders.

4. A honing tool according to claim 3, wherein said housing and said guide body each define at least two bores, one of same being defined on each side of said longitudinal slot, said bores each containing a helical spring, said helical springs including ends and said ends being fastened detachably to a respective one of said shells under pre-stress.

5. A honing tool according to claim 4, further including a pair of discs on each side of said housing, said discs being movably mounted in said housing and said ends of said helical springs being fastened to said discs, said discs further including a tapped hole; and one of said shells being attached to each of said discs by means of a screw disposed in said tapped hole.

6. A honing tool according to claim 4, further including a bush surrounding each of said helical springs, said bush extending through bores defined in said guide body and said housing and thereby fixing said guide body to said housing.

7. A honing tool according to claim 3, wherein said guide body comprises four guide-cheeks, said guide-cheeks being fixed respectively in pairs opposite one another in said housing.

8. A honing tool according to claim 1, further including a plurality of leaf-springs, said leaf-springs being fastened inside said shells and disposed to at least partially overlap said thrust pistons thereby to secure said thrust pistons when said associated shell is removed.

* * * * *